United States Patent [19]

Diethelm

[11] Patent Number: 4,794,654

[45] Date of Patent: Jan. 3, 1989

[54] DRAIN PLUG

[75] Inventor: Alois Diethelm, Tuggen, Switzerland

[73] Assignee: Geberit AG, Jona, Switzerland

[21] Appl. No.: 97,889

[22] Filed: Sep. 17, 1987

[30] Foreign Application Priority Data

Mar. 17, 1987 [CH] Switzerland ..... 1005/87

[51] Int. Cl.[4] ..... A47K 1/14

[52] U.S. Cl. ..... 4/295; 4/287

[58] Field of Search ..... 4/295, 205, 204, 287; 215/355

[56] References Cited

U.S. PATENT DOCUMENTS

| | | | |
|---|---|---|---|
| 1,370,170 | 3/1921 | Ullman | 4/295 |
| 1,384,038 | 7/1921 | Becker | 4/295 |
| 1,607,521 | 11/1926 | Frankenberger | 4/295 |
| 2,139,361 | 12/1938 | Fredrickson | 4/295 |
| 2,194,940 | 3/1940 | Hiertz | 4/295 |
| 2,355,979 | 8/1944 | Keyzer | 4/295 |
| 2,460,768 | 2/1949 | Riley | 4/295 |
| 2,801,021 | 7/1957 | Wood | 4/295 X |
| 3,102,277 | 9/1963 | Anderson | 4/295 |
| 4,188,676 | 2/1980 | Tolnai et al. | 4/295 |
| 4,420,844 | 12/1983 | Puckett et al. | 4/295 |
| 4,751,752 | 6/1988 | Ewing | 4/287 |

*Primary Examiner*—John Petrakes

*Attorney, Agent, or Firm*—Pollock, Vande Sande & Priddy

[57] ABSTRACT

The sealing stopper has a lid (1) which is set onto a sealing part (2) with a conical sealing surface (8), leaving an annular space (15). At the bottom side of the lid rim (11) is a protrusion with a hemispheric recess, into which an end segment (4) of a chain (3) is set. In this manner, the latter is directly and tightly fastened to the sealing body and has no protruding parts on its upper side which could interfere with use of the stopper in the drain valve of a bathtub.

5 Claims, 1 Drawing Sheet

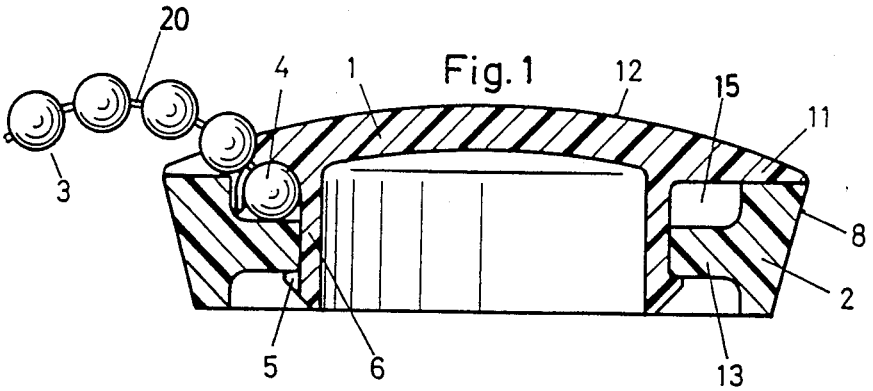
Fig. 1
Fig. 2
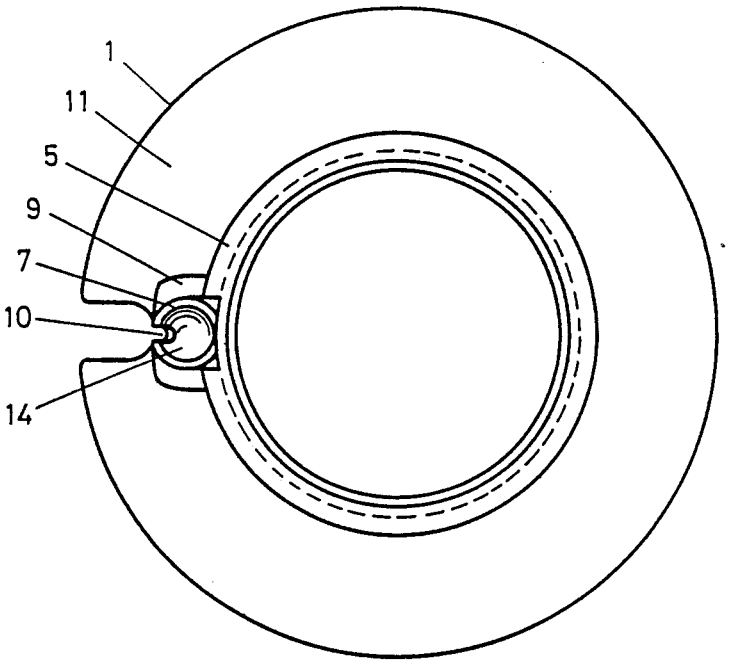
Fig. 3
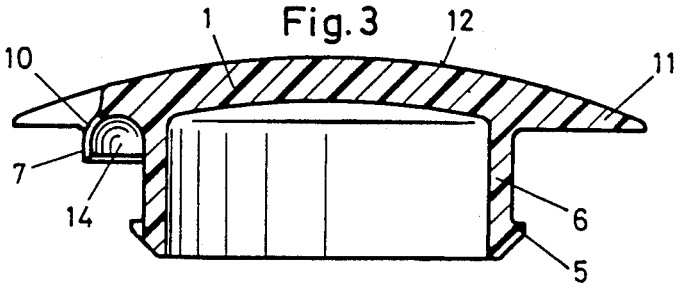

DRAIN PLUG

FIELD OF THE INVENTION

The invention concerns a sealing stopper for a drain valve with a sealing body, having an annular sealing surface, fastened to a chain.

BACKGROUND OF THE INVENTION

A stopper of this type is disclosed in CH-A 544 540, where a protruding ear is provided on the upper side of the stopper, to which ear a chain is fastened by means of a two-part locking device.

SUMMARY OF THE INVENTION

The invention is intended to create a sealing stopper of the above-mentioned type, but with fewer individual parts, and with a sealing body which has no interfering parts on the upper side.

The problem is solved by fastening a segment of the chain directly and tightly onto the sealing body.

The sealing stopper according to the invention has the advantage of a simple design with only a few parts. Protruding parts and parts which are complicated to install have been avoided.

BRIEF DESCRIPTION OF THE DRAWING

In order that the invention may be more clearly understood, reference will now be made to the accompanying drawings, wherein an embodiment of the invention is shown for purposes of illustration, and wherein FIG. 1 is a cross section view through a sealing stopper according to the invention, FIG. 2 is a bottom view of a lid, and FIG. 3 is a cross section view through the lid according to FIG. 2.

DESCRIPTION OF PREFERRED EMBODIMENT

The sealing stopper shown belongs to the drain system of a bathtub (not shown). An annular sealing part 2, e.g., of soft PVC, has a downward tapered sealing surface 8 which, in a locked state, rests against the complementary surface of the valve seat. Set onto the sealing part 2 is a lid 1 of relatively hard synthetic material, such as POM (polyoxyethylene), which has an upper surface 12, extending outward to the sealing surface 8. Molded onto the bottom side of the lid 1 is a cylindrical neck 6, which rests tightly against an inwardly directed flange 13 of the sealing part 2 and reaches behind it with an annular shoulder 5.

From the neck 6 a rim 11 extends outward and rests with its bottom side on the sealing part 2. Between the rim 11 and the sealing part 2 an annular space 15 is defined, into which an end segment 4 of a ball chain is set. As shown in FIGS. 2 and 3, this segment 4 sits in a hemispherical recess 14 of a projection 7, arranged on the bottom side of rim 11. This projection 7 is reinforced by two flanges 9 and has a narrow slit 10, which is also continued in the rim 11, and is somewhat wider than a joining segment 20 of the ball chain.

The end segment 4 may be formed the same as the remaining chain segments. When assembling the parts, the ball 4 is set into the recess 14 and the sealing body 2 set onto the lid 1. As the part 2 is attached in a removable manner, it is possible to replace the chain 3, if necessary, in a simpler manner. The lid is fashioned from a material which can easily be dyed in various colors.

I claim:

1. Sealing stopper for a drain valve, comprising:

(a) a first member comprising an annular sealing body having an outer sealing surface and an inwardly extending, annular flange;

(b) a second member comprising a lid having a rim and an integral, downwardly extending annular neck portion for assembly into abutting relation with said flange;

(c) an annular space being defined by said rim, said neck portion and said sealing body, said space being adapted to receive an end segment of a chain means prior to assembly of said lid with said sealing body;

(d) whereby said chain means is removably attached to said sealing stopper without the use of tools.

2. Sealing stopper according to claim 1, wherein said chain (3) is set into a slit (10) in the rim (11) of said lid (1).

3. Sealing stopper according to claim 2, comprising, on an underside of said rim (11), a downward protrusion (7) with a hemispheric recess (14), for receiving said segment (4) of said chain (3).

4. Sealing stopper according to claim 1, wherein the lid (1) is made of relatively hard material, such as POM (polyoxymethylene), and said sealing part is made of relatively soft synthetic material, such as soft PVC.

5. Sealing stopper according to claim 1, wherein said lid is removably coupled to said sealing part by means of an inwardly extending shoulder adjacent to the base of said neck portion.

* * * * *